US008708600B2

(12) United States Patent
Drieu et al.

(10) Patent No.: US 8,708,600 B2
(45) Date of Patent: Apr. 29, 2014

(54) SUBSEA INJECTION OF OIL DISPERSANT

(75) Inventors: Michael Duggan Drieu, Magnolia, TX (US); Patrick Michael Cargol, Jr., The Woodlands, TX (US); Jonathan Eryl Rogers, The Woodlands, TX (US); Pierre Albert Beynet, Houston, TX (US); Stanley Silva, Sugar Land, TX (US)

(73) Assignees: Wild Well Control, Inc., Houston, TX (US); BP Corporation North America Inc., Houston, TX (US)

( * ) Notice: Subject to any disclaimer, the term of this patent is extended or adjusted under 35 U.S.C. 154(b) by 35 days.

(21) Appl. No.: 13/294,785

(22) Filed: Nov. 11, 2011

(65) Prior Publication Data

US 2012/0201604 A1 Aug. 9, 2012

Related U.S. Application Data

(63) Continuation-in-part of application No. 13/237,549, filed on Sep. 20, 2011.

(60) Provisional application No. 61/384,358, filed on Sep. 20, 2010, provisional application No. 61/412,571, filed on Nov. 11, 2010.

(51) Int. Cl.
*E02B 15/00* (2006.01)

(52) U.S. Cl.
USPC ..... 405/62; 405/60; 405/64; 210/922; 210/925

(58) Field of Classification Search
USPC ..... 405/60, 62, 64; 166/338, 344, 351, 363, 166/364, 90.1; 210/747.5, 170.09, 170.11, 210/922–925
See application file for complete search history.

(56) References Cited

U.S. PATENT DOCUMENTS 4,318,442 A 3/1982 Lunde et al.
4,421,436 A 12/1983 Burns (Continued)

FOREIGN PATENT DOCUMENTS

WO 2005115603 A2 12/2005
WO 2012148993 A2 11/2012

OTHER PUBLICATIONS

BP—"Deepwater Horizon Containment and Response: Harnessing Capabilities and Lessons Learned," BP report dated Sep. 1, 2010, 46 pages.

(Continued)

*Primary Examiner* — Benjamin Fiorello
*Assistant Examiner* — Carib Oquendo
(74) *Attorney, Agent, or Firm* — Patterson & Sheridan, L.L.P.

(57) ABSTRACT

In one embodiment, dispersants are injected directly into a plume of oil in a subsea environment. The dispersant is supplied from a vessel, through a tubular string and flows through a routing manifold into a flexible hose. The hose then transports the dispersant to a distribution manifold, which is disposed on the sea floor, and permits injection of dispersants at multiple locations at the same time around the leaking oil. Injection of dispersants from the distribution manifold may be through injection wands, or the dispersant may be transferred to a containment or collection device located above the plume of oil, wherein nozzles are disposed around the circumference of such containment or collection device. If the dispersants are injected into the leaking oil through injection wands, such wands may be held and/or manipulated by an ROV.

15 Claims, 6 Drawing Sheets

(56) References Cited

U.S. PATENT DOCUMENTS

| | | | | |
|---|---|---|---|---|
| 4,456,071 | A | 6/1984 | Milgram | |
| 5,618,468 | A | 4/1997 | Canevari et al. | |
| 5,728,320 | A | 3/1998 | Fiocco et al. | |
| 5,753,127 | A | 5/1998 | Riley | |
| 5,942,219 | A | 8/1999 | Hendriks | |
| 6,013,157 | A | 1/2000 | Li et al. | |
| 6,140,285 | A | 10/2000 | Banks et al. | |
| 6,194,473 | B1 | 2/2001 | Lessard et al. | |
| 6,261,463 | B1 | 7/2001 | Jacob et al. | |
| 6,517,726 | B2 | 2/2003 | Allen et al. | |
| 6,660,698 | B2 | 12/2003 | Riley | |
| 7,223,362 | B2 | 5/2007 | Riley | |
| 2002/0005439 | A1 * | 1/2002 | Kendall | 239/223 |
| 2005/0025574 | A1 | 2/2005 | Lazes | |
| 2012/0018165 | A1 | 1/2012 | Crossley et al. | |
| 2012/0125623 | A1 | 5/2012 | Cargol, Jr. et al. | |

OTHER PUBLICATIONS

Corum, Jonathan, et al.—"Methods That Have Been Tried to Stop the Leaking Oil," The New York Times article updated Aug. 17, 2010, 11 pages.

Dlouhy, Jennifer A.—"BP says spill battle advanced technology," Houston Chronicle article dated Sep. 2, 2010, 1 page.

Krauss, Clifford, et al.—"Acrimony Behind the Scenes of Gulf Oil Spill," The New York Times article dated Aug. 26, 2010, 8 pages.

Lyons, William C., et al.—"4.21 Offshore Drilling Operations," Standard Handbook of Petroleum & Natural Gas Engineering, Second Edition, Gulf Professional Publishing, an imprint of Elsevier, Inc., copyright 2005, pp. 4-558-4-565.

Oil & Gas UK—"Secretary of State Views Enhancements to UK Oil Spill Response Capability," press release dated Oct. 8, 2010, The United Kingdom Offshore Oil and Gas Industry Association trading as Oil & Gas UK, 3 pages.

PCCI Marine and Environmental Engineering—"Oil Spill Containment, Remote Sensing and Tracking for Deepwater Blowouts: Status of Existing and Emerging Technologies," Final Report dated Aug. 12, 1999, funded by the U.S. Minerals Management Service, 121 pages.

Agence France-Presse —"Dump, Baby, Dump! U.S. approves use of subsea dispersants to battle oil slick," article dated May 14, 2010, on Grist Magazine, Inc. Website http://www.grist.org, 2 pages.

CNN—"Feds tell BP to cut use of oil dispersants in Gulf," article dated May 24, 2010, on CNN Website http://articles.cnn.com, 2 pages.

National Ocean Industries Association (NOIA)—"Update 2—NOIA Member Companies Engaged in Cohesive Deepwater Horizon Response," Press Release dated May 10, 2010, on NOIA Website www.noia.org, 4 pages.

Tilove, Jonathan—"Subsea dispersants the right call, EPA administrator believes," article published Jun. 27, 2010, on The Times Picayune, New Orleans, Louisiana, Website http://www.nola.com (with posted Comments), 9 pages.

* cited by examiner 115
100
120
130
125
200
220
TOP HAT
210
WAND
210
WAND
210
WAND
205

SUBSEA INJECTION OF OIL DISPERSANT

CROSS-REFERENCE TO RELATED APPLICATIONS

This application claims benefit of U.S. provisional patent application No. 61/412,571, filed Nov. 11, 2010, which is herein incorporated by reference in its entirety.

This application is a continuation-in-part of U.S. patent application Ser. No. 13/237,549, filed Sep. 20, 2011, which claims benefit of 61/384,358, filed Sep. 20, 2010, which are also herein incorporated by reference in their entirety.

BACKGROUND OF THE INVENTION

1. Field of the Invention

The present invention relates to the management of hydrocarbons released below the surface of a body of water. More particularly, the invention relates to the management of hydrocarbons released from a subsea oil/gas well, or from casings or risers coming from the well. More particularly still, the invention relates to the use of dispersants applied in a subsea environment to reduce the ill effects of the uncontrolled release of hydrocarbons.

2. Description of the Related Art

Once an oil spill has taken place, countermeasures are taken to try to reduce the adverse effects of the spilled oil on the environment. Dispersants, chemicals that are applied directly to the spilled oil in order to remove it from the water surface, are one kind of countermeasure. Dispersants are generally less harmful than the highly toxic oil leaking from the source and biodegrade in a much shorter time span.

When dispersants are applied to surface oil slicks, they act to break up the slicks and move the oil, in the form of tiny droplets, from the water surface down into the water column (the volume of water extending from the surface to the bottom). In a typical scenario, the dispersant is applied to the water surface. Next, molecules of the dispersant attach to the oil, causing it to break into droplets. Thereafter, wave action and turbulence disperse the oil-dispersant mixture into the water column, so that the oil that had been concentrated at the surface is diluted within the water column.

The forgoing is especially useful in instances where oil is released at or near the surface of the water, such as a ruptured tank on a vessel carrying crude oil or a leak from a well at the upper end of a tubing string. The presently available methods, however, are limited to treatment of the oil once it is on the surface and is not helpful in treatment of the oil at its subsea source. What is needed is a more effective way to treat well spills that take place in a subsea environment at the source of the spill to prevent hydrocarbons from spreading throughout the water columns before it hits the surface and spreads over a greater area before it is contained.

SUMMARY OF THE INVENTION

In one embodiment, dispersants are injected directly into a plume of oil in a subsea environment. The dispersant is supplied from a vessel, through a tubular string and flows through a routing manifold into a flexible hose. The hose then transports the dispersant to a distribution manifold, which is disposed on the sea floor, and permits injection of dispersants at multiple locations at the same time around the leaking oil. Injection of dispersants from the distribution manifold may be through injection wands, or the dispersant may be transferred to a containment or collection device located above the plume of oil, wherein nozzles are disposed around the circumference of such containment or collection device. If the dispersants are injected into the leaking oil through injection wands, such wands may be held and/or manipulated by an ROV. In another embodiment, the dispersant is supplied from a vessel, through a tubular string and flows through a routing manifold into a flexible hose and is connected to a containment or collection device locatable above the plume of oil, wherein the dispersant is applied via nozzles disposed in or around the ring to the oil being collected. In yet another embodiment, the dispersant is supplied from a vessel, through a tubular string, and is directly applied via nozzles disposed in or around a containment or collection device locatable above the plume of oil.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In one embodiment, oil dispersant is injected into a subsea oil plume using a coiled tubing supply line from a work vessel. The vessel is typically a multi-service construction vessel capable of housing and dispensing thousands of feet of coiled tubing as well as thousands of gallons of approved dispersant in storage tanks along with the adequate facilities for pumping the dispersant into the coiled tubing string.

In one embodiment, over 20,000 gallons of dispersant are stored on the vessel for subsea injection. In one embodiment the dispersant used is Corexit® made by Nalco. More specifically, the material is Corexit EC9500A made primarily of hydrotreated light petroleum distillates, propylene glycol and a proprietary organic sulfonate.

In one embodiment, the coiled tubing is connected to a flexible hose via a connection assembly at a routing manifold that is located subsea. The flexible hose is then connected to a distribution manifold disposed on the sea floor, which in turn provides multiple outlets for distributing dispersant. Injection of the dispersant may be through one or more injection wands, and/or the dispersant may be transferred to a containment or collection device located above the plume of oil, wherein nozzles are disposed around the circumference of such containment or collection device. In another embodiment, the flexible hose coming from the routing manifold is directly connected to the containment or collection device located above the plume of oil, and dispersant is injected directly to the containment or collection device.

Typically, the methods and apparatus of the present invention are used with Remotely Operated Vehicles (ROVs). For example, as the coiled tubing is dispensed into the ocean, an ROV may survey the route approaching the subsea source of oil for evidence of debris which could interfere with the dispersant operation. Furthermore, an ROV may handle and position the wands used for injecting the dispersant into the leaking oil. An ROV may also connect the flexible hose to the containment or collection device located above the plume of oil.

Figure 1:
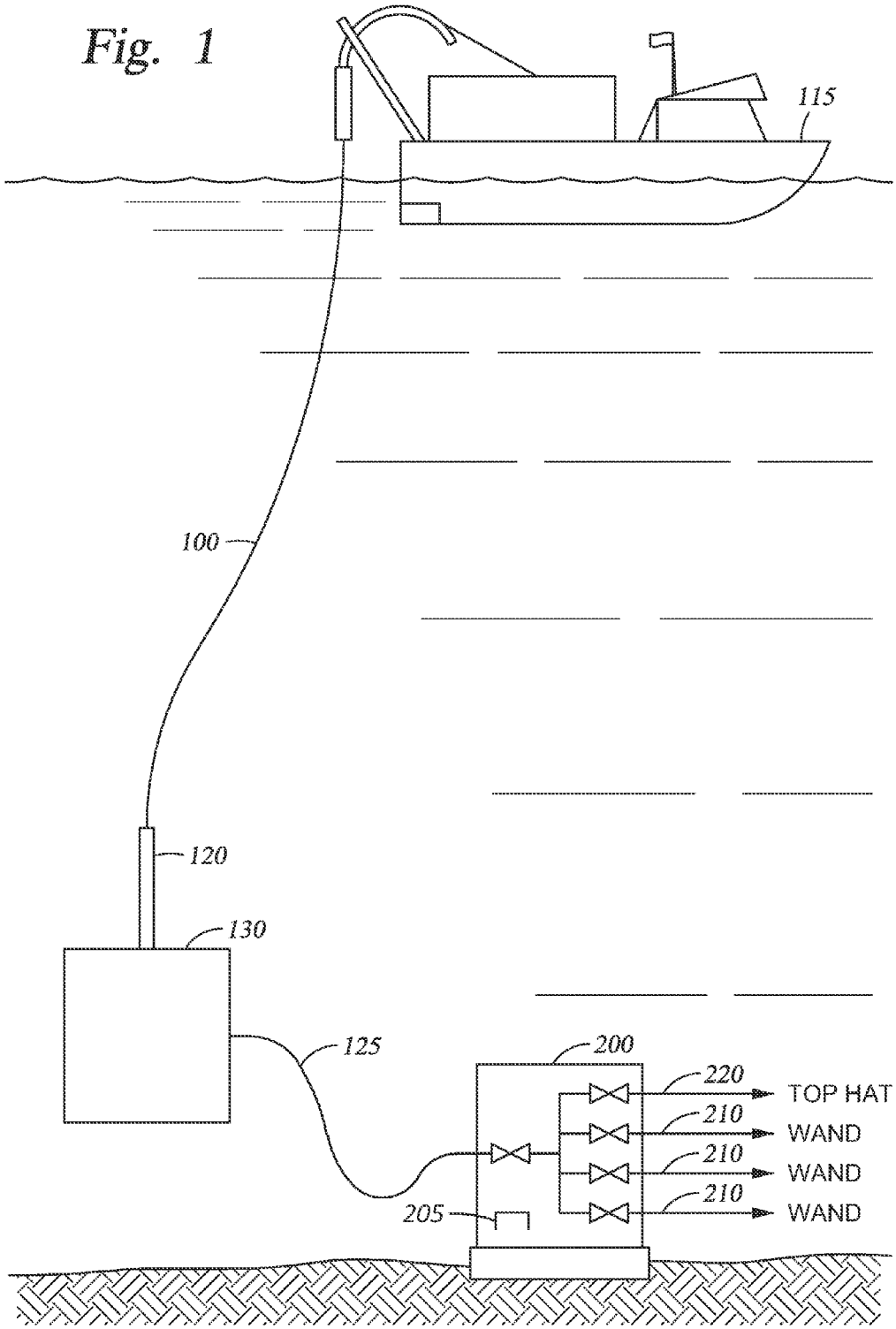
FIG. 1 is a diagram showing a typical arrangement of the subsea injection of dispersant at a location of spilled oil.

FIG. 1 is a diagram showing a typical arrangement of an embodiment of a dispersant injector. An initial string of coiled tubing 100 (typically 2" diameter) extends from a vessel 115 to a routing manifold 130 located between the surface and a subsea location of leaking oil (not shown). At the routing manifold 130, the coiled tubing 100 is connected to a more flexible hose 125 (typically a 1" chemical hose) via a connection assembly 120 (shown in more detail in FIG. 4). The flexible hose 125 terminates in a distribution manifold 200 on the sea floor that is located in the area of leaking oil. The distribution manifold 200 may separate a source of dispersant into multiple separate streams 210, 220, each for use at different locations relative to the leaking oil. In FIG. 1, for instance, the distribution manifold 200 separates the source of dispersant into four separate streams 210, 220. Three of the streams 210 go to an injection wand 275 (FIG. 5), each, wherein the wand is simply a device including a nozzle for dispersing fluid that includes handles for grasping and manipulation by an ROV. One stream 220 in FIG. 1 goes to a collection or containment device, such as a "top hat" 300, as will be discussed further herein.

After the described connections are accomplished, pumping devices on the vessel 115 begin pumping dispersant down the coiled tubing 100, through the flexible hose 125, and out of the distribution manifold 200 via streams 210, 220 to various locations around the area of leaking oil. If a particular stream 210, 220 is unneeded during dispersant injection, the wand 275 or dispersant injector may be placed in a blank connection, or "parking spot" 205 whereby a hose can be connected remotely to the blank output and effectively cease injection of dispersants through that hose. In the case of use with a collection device, the blank connection 205 provides an easy and safe way to temporarily halt the injection of dispersant into the collection device when an ROV reconnects a hose from an active output of the distribution manifold 200 to the parking spot 205. As the dispersant is injected, VOC (Volatile Organic Compounds) emissions are continuously monitored at the surface of the ocean and dispersant injection is increased or decreased according to a predetermined table. Thereafter, the dispersant pumping is terminated and the equipment can be retrieved to the vessel 115.

Figure 2:
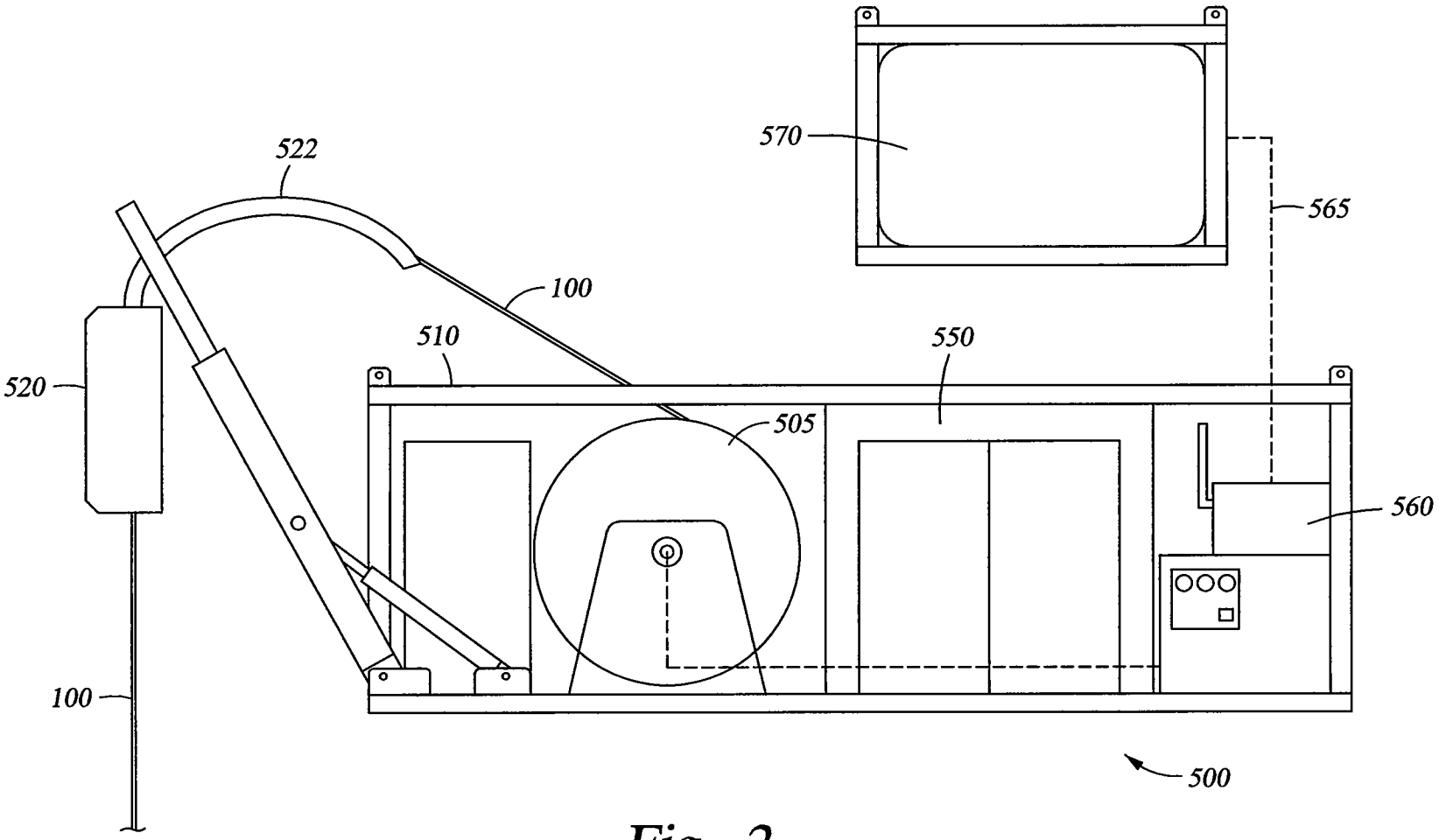
FIG. 2 illustrates a skid-mounted, rapidly deployable coiled tubing unit.

FIG. 2 illustrates an example of a skid-mounted, rapidly deployable coiled tubing unit 500 that could be used to deploy the coiled tubing 100 for the dispersant injection. FIG. 2 shows a skid 510 which includes a reel 505 of up to 11,000 feet of coiled tubing 100. Also included is an injector 520 which is movable and usable to dispense the coiled tubing 100 from the reel 505, which can be located on the deck of a vessel, into the ocean. In one embodiment, the injector 520 includes a gooseneck assembly 522 which is deployed on a telescopic A-frame and extendible to a location whereby the coiled tubing 100 can be dispensed directly into the ocean. Also included on the skid 510 is a container 550 that may house flexible hose 125 and connection devices for connection between the coiled tubing 100 and the hose 125, and between the hose 125 and injection wands 275. Additionally, an electric pump 560 may be disposed on the skid 510 for use in pumping dispersants through the coiled tubing string 100. A tank or tanks for bulk storage of dispersants 570 is available separately on the skid 510 and may be supplied to the electric pump 560 from a dedicated line 565 on the skid 510. In FIG. 2, the injector 520 is in a deployed position and coiled tubing 100 carrying pressurized dispersant is being disposed from the injector head into the ocean.

Figure 3:
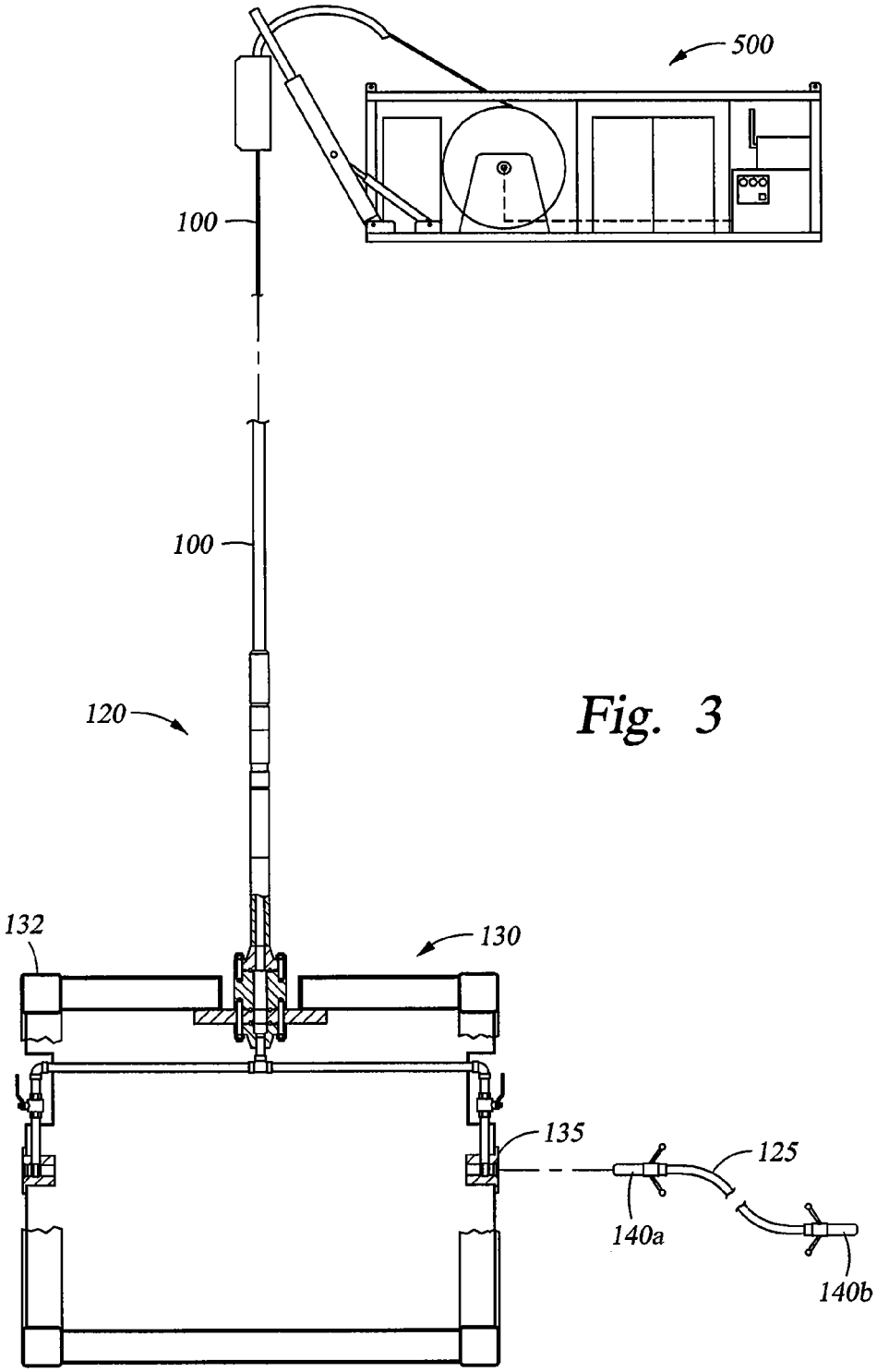
FIG. 3 is a an illustration showing a routing manifold of the dispersant injection apparatus, which connects coiled tubing from a coiled tubing unit to a flexible hose via a connection assembly.

FIG. 3 is an illustration showing the connections at the routing manifold 130 of the dispersant injector, wherein coiled tubing 100 is connected to the connection assembly 120 of the routing manifold 130 while located at the surface. The coiled tubing 100 and routing manifold 130 are then sent down into the ocean by operating the coiled tubing unit 500. The routing manifold 130 provides an assembly to allow the flexible hose 125 to connect at the routing manifold 130. As discussed above, the routing manifold 130 is located between the surface of the ocean and the floor of the ocean, and is weighted such that when coiled tubing 100 connects to the connection assembly 120, which is attached to the routing manifold 130 at a top end 132 and at a central position of the routing manifold 130, the routing manifold 130 remains in a substantially vertical position. This configuration helps minimize stress on the coiled tubing 100. The distribution manifold 200 is lowered to the sea floor using a crane of the vessel 115.

Figure 4:
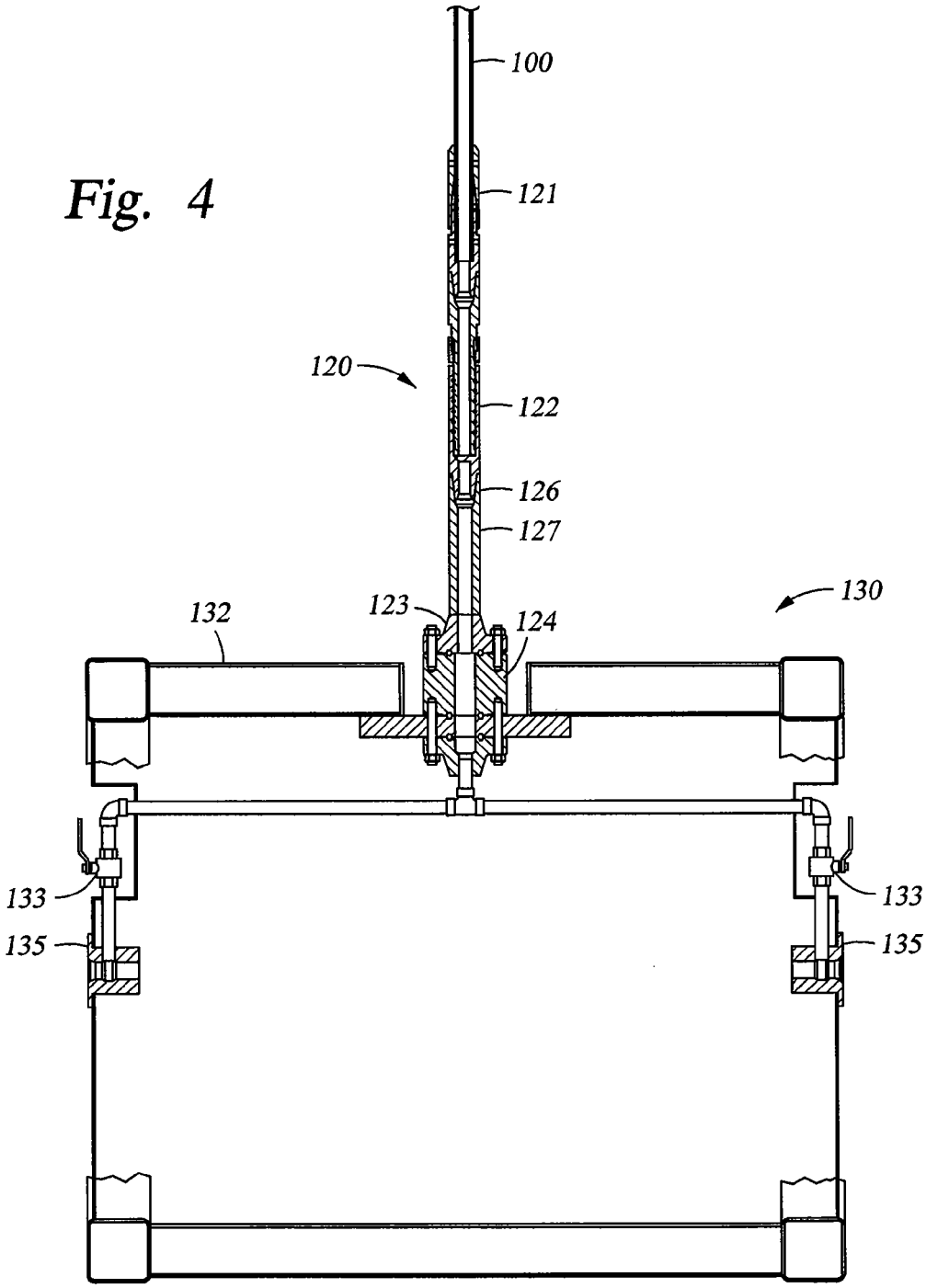
FIG. 4 is a cross sectional view of the connection assembly and routing manifold.

FIG. 4 shows a cross sectional view of the connection assembly 120, which is connected to the top end 132 of the routing manifold 130 at its central position. The connection assembly 120 may include a coil connector 121, a locking swivel joint 122, a PAC connection 126, a cross-over flange 123, and a double stud flange 124. The coil connector 121, which accepts the coiled tubing 100 from the vessel 115, connects to the locking swivel joint 122, which connects to a PAC connection 126. A tubular 127 may elongate the portion between the PAC connection 126 and the cross over flange 123, or the PAC Connection 125 may be directly connected to the cross over flange 123. The double stud flange 124 connects to the cross over flange 123 and is centrally positioned within an opening in the top end 132 of the routing manifold 130. A piping assembly within the routing manifold 130 is connected to the bottom end of the double stud flange 124, and the piping assembly tees into one or more hot stab receptacles 135 located on the outer faces of the routing manifold 130, wherein the flexible hose 125 may connect to the routing manifold 130. Each receptacle 135 includes one or more check valves 133 to facilitate quick change-out and prevent hydrocarbon ingress and egress.

The hot stab receptacle 135 is located on the outer face of the routing manifold 130 and is capable of receiving a hot stab connector 140*a*. As shown in FIG. 3, hot stab connectors 140*a, b* are located on respective ends of the flexible hose 125, wherein one hot stab connector 140*a* may be received by the hot stab receptacle 135 located on the routing manifold 130. In one embodiment, the other hot stab connector 140*b* may be received by a hot stab receptacle 230*a* located on the distribution manifold 200. In yet another embodiment, the other hot stab connector 140*b* may be received by a hot stab receptacle 310 located in the top hat 300.

Figure 5:
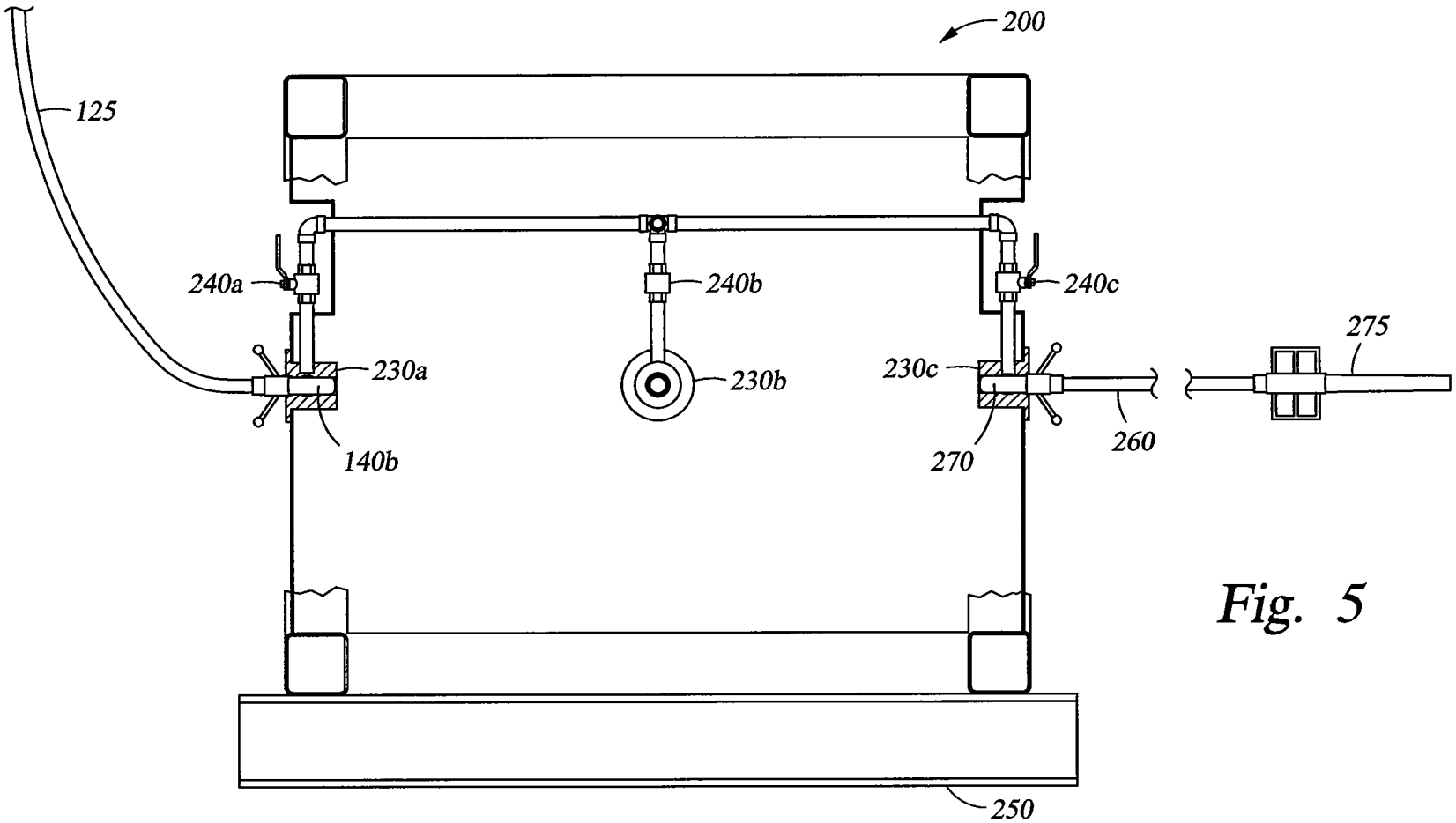
FIG. 5 is an illustration of a distribution manifold, wherein the flexible hose connects to the manifold and a second flexible hose connects to an injection wand to distribute the dispersant.

FIG. 5 shows an illustration of the distribution manifold 200, which sits on a mud mat 250 on the sea floor. The distribution manifold 200 receives dispersant from the flexible hose 125 coming from the routing manifold 130, and thereafter distributes the dispersant into one or more streams 210, 220 (as shown in FIG. 1). The distribution manifold 200 receives the dispersant by means of the hot stab connector 140*b* that is inserted into the hot stab receptacle 230*a* located on the distribution manifold 200. The number of streams 210, 220 of the distribution manifold 200 is determined by the number hot stab receptacles 230*a-c* connected to the distribution manifold, as well as the number of second flexible hoses 260 connected to those receptacles 230*a-c* in the distribution manifold 200. Like the flexible hose 125 coming from the routing manifold 130, the second flexible hoses 260 also have hot stab connectors 270 on each of their ends. The second flexible hoses 260 connect to the distribution manifold 200 via the hot stab connectors 270 into the hot stab receptacles 230*b, c*. All hot stab receptacles 230*a-c* on the distribution manifold 200 include one or more check valves 240*a-c* to facilitate quick change-out and prevent hydrocarbon ingress and egress. While FIG. 5 only shows two receptacles 230*b, c* that are suitable for connection to a second flexible hose 260, it is contemplated that more receptacles could be connected at the distribution manifold 200 to provide more outlets for injecting dispersant.

The second flexible hoses 260 may also connect, via hot stab connector 270, to an injection wand 275 at another end, which is used to inject dispersant into the leaking oil. The injection wands 275 may be held and/or manipulated by an ROV (not shown). The second flexible hose 260 may also connect to a top hat collection device 300 by inserting the hot stab connector 270 into a hot stab receptacle 310 connected to a dispersant ring 350 in the top hat 300.

U.S. Patent Application No. 61/384,358 entitled "Containment Cap for Controlling Subsea Blowout" assigned to the assignee of the present invention discloses a collection or containment device called the "top hat" assembly 300 for installation over a subsea well experiencing blow-out conditions. That patent application is incorporated herein by reference in its entirety. In one embodiment, the top hat 300 includes, radially disposed around its interior, nozzles which are constructed and arranged to spray oil dispersant into a plume of oil which is being collected by the top hat 300. In that instance, a subsea connection is made between flexible hose 125, 260 carrying dispersant and the hot stab receptacle 310 on the exterior of the top hat 300, and plumbing in the top hat provides dispersant to the various nozzles.

Figure 6:
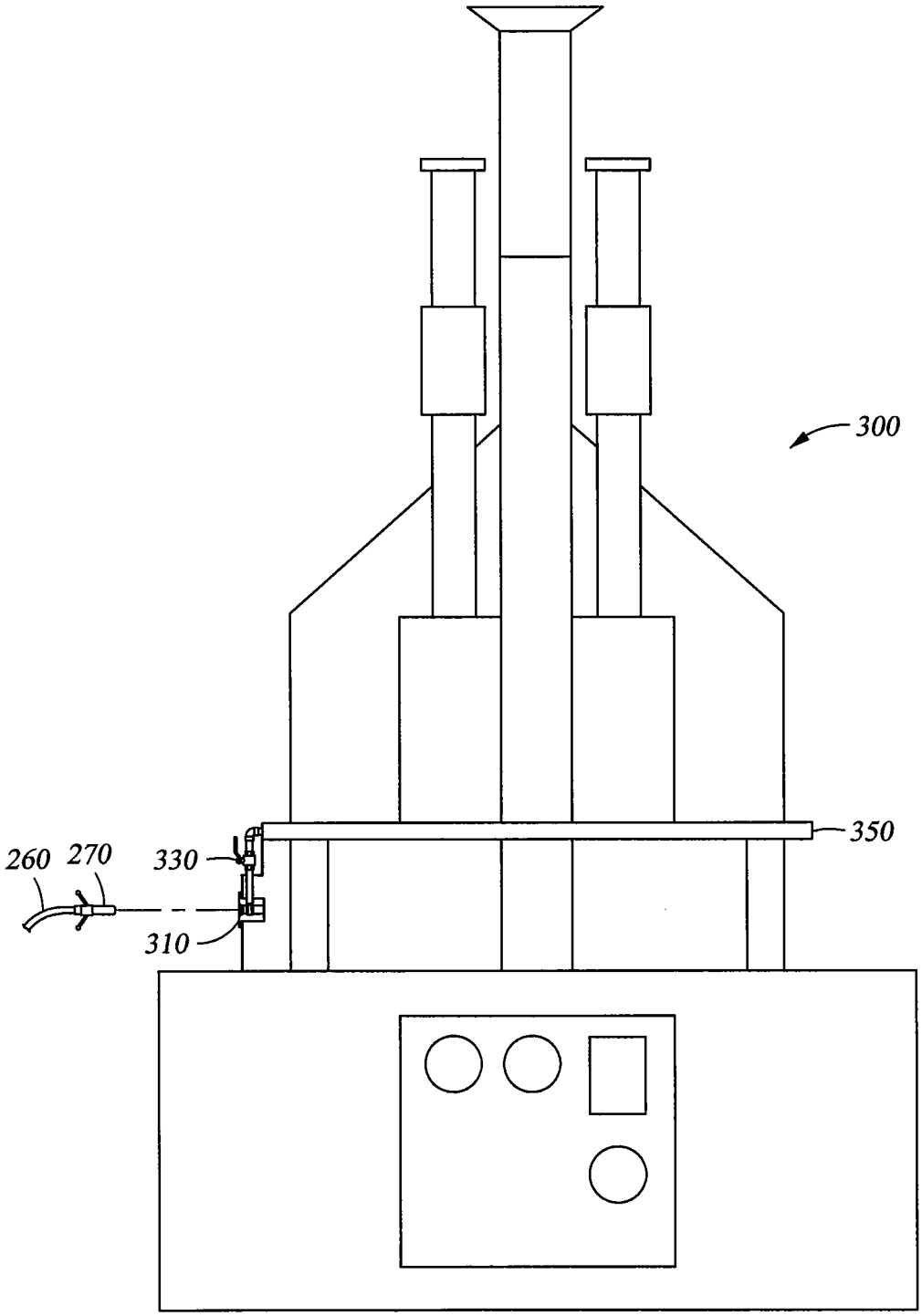
FIG. 6 is an illustration of a collection device known as a "top hat," wherein either the first or second flexible hose may connect to such top hat to distribute dispersant into oil being collected within the top hat.

FIG. 6 also shows an illustration of the top hat 300 collection device. As discussed, in one embodiment, the hot stab receptacle 310 is piped to a dispersant ring 350 that is radially disposed around the interior of the top hat 300. Nozzles (not shown) are radially arranged around the interior of the dispersant ring 350 so that dispersant may be sprayed into a plume of oil being collected by the top hat 300 when a dispersant source is connected to the hot stab receptacle 310. The receptacle 310 includes a check valve 330 to facilitate quick change-out and prevent hydrocarbon ingress and egress. In one embodiment, the second flexible hose 260 from the distribution manifold 200 connects to the hot stab receptacle 310 via hot stab connector 270. In another embodiment, instead of receiving the flexible hose 260 from the distribution manifold 200, the dispersant ring 350 of the top hat 300 may receive the flexible hose 125 directly from the routing manifold 130. In yet another embodiment, the dispersant ring 350 of the top hat 300 may receive a flexible hose or other piping that comes directly from the vessel 115 (not shown).

A method of using the subsea injection apparatus as described above includes injecting dispersant into coiled tubing 100 from the vessel 115 at the surface. The dispersant is transferred to the flexible hose 125 via the connection assembly 120 at the routing manifold 130, and then into the distribution manifold 200 sitting on a mud mat 250 on the sea floor. Depending on the number of second flexible hoses 260 available, the dispersant is injected by one or more different streams 210, 220 into various areas of the oil leak. The second flexible hoses 260 may connect to injection wands 275, which can be manipulated by an ROV into specific areas of a leak, and/or the second flexible hose 260 may be connected to the top hat 300, which injects the dispersant into the oil being collected within the top hat 300.

Another method of the present invention includes injecting dispersant into coiled tubing 100 from the vessel 115 at the surface and thereafter transferring it to the flexible hose 125 at the routing manifold 130. The dispersant is then injected into the top hat 300, which distributes the dispersant to the oil being collected within the top hat. Alternatively, dispersant may be directly injected into a flexible hose 125 from the vessel 115 and into the top hat 300, wherein the dispersant is injected into the oil being collected within the top hat (not shown).

While the foregoing is directed to embodiments of the present invention, other and further embodiments of the invention may be devised without departing from the basic scope thereof, and the scope thereof is determined by the claims that follow.

The invention claimed is:

1. A system for treating a subsea oil leak, comprising:
a supply of dispersant;
a coiled tubing unit having:
a reel of coiled tubing;
an injector operable to dispense the coiled tubing from the reel; and
a pump operable to intake dispersant from the supply and inject the dispersant through the coiled tubing;
a routing manifold having:
a connection assembly for receiving an end of the coiled tubing; and
an outlet in fluid communication with the connection assembly;
a hose for connecting the routing manifold outlet to an inlet of a distribution manifold; and
the distribution manifold having:
a mud mat for resting on a sea floor;
the inlet for receiving the hose; and
an outlet in communication with the inlet.

2. The system of claim 1, further comprising an injection wand and a second hose for connecting the injection wand to the distribution manifold outlet.

3. The system of claim 2, wherein the injection wand has a handle for holding by a remotely operated vehicle (ROV).

4. The system of claim 1, further comprising a collection device and a second hose for connecting the collection device to the distribution manifold outlet.

5. The system of claim 4, wherein the collection device has a ring of nozzles for spraying the dispersant into the subsea oil leak.

6. The system of claim 1, wherein the inlet and the outlets are hot stab receptacles and the hose has hot stab connectors.

7. The system of claim 1, wherein the distribution manifold has a second outlet in communication with the inlet.

8. The system of claim 1, wherein:
the coiled tubing unit is mounted on a skid, and
the coiled tubing unit further has an A-frame for deploying the injector.

9. A method for treating a subsea oil leak, comprising:

deploying a vessel to an area of the subsea oil leak, the vessel having a supply of dispersant;

lowering a routing manifold from the vessel and into a body of water using a first conduit to a depth above a floor of the water body and to a position adjacent a distribution manifold located on the water body floor;

connecting the routing manifold to the distribution manifold using a second conduit;

connecting a third conduit to the distribution manifold; and operating a pump onboard the vessel, thereby injecting the dispersant from the supply and into the subsea oil leak via the first conduit, the routing manifold, the second conduit, the distribution manifold, and the third conduit.

10. The method of claim 9, wherein:

the third conduit connects an injection wand to the distribution manifold, and the dispersant is injected into the subsea oil leak by a remotely operated vehicle (ROV) handling the injection wand.

11. The method of claim 9, wherein:

the third conduit connects a collection device to the distribution manifold, and the dispersant is injected into the subsea oil leak by the collection device having a ring of nozzles.

12. The method of claim 9, wherein the first conduit is coiled tubing and the second and third conduits are hoses.

13. The method of claim 12, wherein the hoses are connected by a remotely operated vehicle (ROV) using hot stabs.

14. The method of claim 9, further comprising connecting a fourth conduit to the distribution manifold, wherein the dispersant is also injected into the oil leak using the fourth conduit.

15. The method of claim 9, further comprising lowering the distribution manifold to the water body floor using a crane of the vessel.

* * * * *